US011731309B2

(12) United States Patent
Zhang et al.

(10) Patent No.: US 11,731,309 B2
(45) Date of Patent: Aug. 22, 2023

(54) BAMBOO STRIP SHAPING DEVICE AND METHOD

(71) Applicant: Nanjing Forestry University, Nanjing (CN)

(72) Inventors: Haiyang Zhang, Nanjing (CN); Yanjun Li, Nanjing (CN); Xinzhou Wang, Nanjing (CN); Zhichao Lou, Nanjing (CN)

(73) Assignee: Nanjing Forestry University, Nanjing (CN)

( * ) Notice: Subject to any disclaimer, the term of this patent is extended or adjusted under 35 U.S.C. 154(b) by 149 days.

(21) Appl. No.: 17/522,786

(22) Filed: Nov. 9, 2021

(65) Prior Publication Data

US 2022/0063126 A1 Mar. 3, 2022

Related U.S. Application Data

(62) Division of application No. 16/833,036, filed on Mar. 27, 2020, now Pat. No. 11,318,635.

(30) Foreign Application Priority Data

Apr. 10, 2019 (CN) ..... 201910285346.3

(51) Int. Cl.
*B30B 15/06* (2006.01)
*B30B 15/34* (2006.01)
(Continued)

(52) U.S. Cl.
CPC ..... *B27K 9/002* (2013.01); *B27J 1/00* (2013.01); *B27J 7/00* (2013.01); *B27K 5/06* (2013.01); *B30B 15/064* (2013.01); *B30B 15/34* (2013.01)

(58) Field of Classification Search
CPC .... B27D 1/083; B27J 1/00; B27J 7/00; D06F 71/18; D06F 71/36; D06F 83/00; D01B 1/16; D01B 1/18; D01B 1/22
(Continued)

(56) References Cited

U.S. PATENT DOCUMENTS 4,564,408 A * 1/1986 Crumbach ..... B29D 11/0073 156/212
4,818,321 A * 4/1989 Shimizu ..... B32B 38/1816 428/17
9,962,894 B1 * 5/2018 McDonald ..... B27N 3/18

FOREIGN PATENT DOCUMENTS

AU 669467 B2 * 11/1995
CN 101618560 A * 1/2010
(Continued)

*Primary Examiner* — Katrina M Stransky
*Assistant Examiner* — Jared O Brown
(74) *Attorney, Agent, or Firm* — Marshall, Gerstein & Borun LLP

(57) ABSTRACT

Disclosed is a bamboo strip shaping method, which includes the following steps: S01: cutting a bamboo tube, and removing inner joints, outer joints and bamboo outer skin; S02: trisecting or quartering the bamboo tube in a longitudinal direction to obtain curved bamboo strips; S03: placing the curved bamboo strips in a bamboo strip shaping device for processing; S04: subjecting the curved bamboo strips to steam treatment and heating softening treatment; S05: pressing and shaping the curved bamboo strips to obtain flattened bamboo strips, and drying for a first time under a maintained pressure; S06: wetting bamboo outer skin surfaces and bamboo inner skin surfaces of the flattened bamboo strips, and drying for a second time; and S07: wetting the bamboo outer skin surfaces and the bamboo inner skin surfaces of the flattened bamboo strips, and drying for a third time.

2 Claims, 1 Drawing Sheet

(51) Int. Cl.

| | |
|---|---|
| ***B27K 9/00*** | (2006.01) |
| ***B27J 1/00*** | (2006.01) |
| ***B27K 5/06*** | (2006.01) |
| ***B27J 7/00*** | (2006.01) |

(58) Field of Classification Search
USPC ..... 144/333; 100/266, 267, 268
See application file for complete search history.

(56) References Cited

FOREIGN PATENT DOCUMENTS

| | | | | | |
|---|---|---|---|---|---|
| CN | 104626296 | A | * | 5/2015 | |
| CN | 105856374 | A | * | 8/2016 | |
| CN | 106835655 | A | * | 6/2017 | ..... D06F 71/36 |
| CN | 108748570 | A | * | 11/2018 | |
| CN | 109016029 | A | * | 12/2018 | |
| CN | 109093813 | A | * | 12/2018 | ..... B27K 5/0085 |
| CN | 110497490 | A | * | 11/2019 | |
| FR | 2514687 | A1 | * | 10/1981 | |
| GB | 675026 | A | * | 9/1952 | |
| KR | 20020014278 | A | * | 2/2002 | |

* cited by examiner

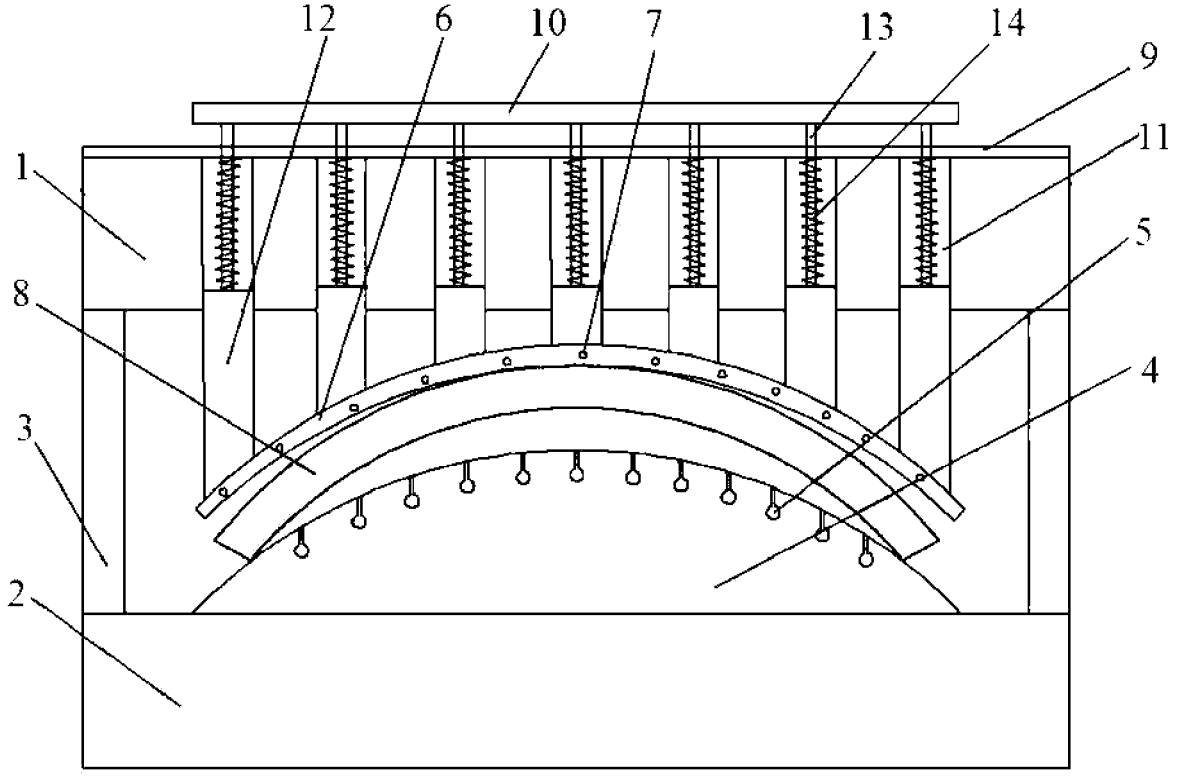
12
6
10
7
13
14
9
11
1
5
8
4
3
2

BAMBOO STRIP SHAPING DEVICE AND METHOD

CROSS-REFERENCE TO RELATED APPLICATIONS

This application is a divisional application which claims the benefit of U.S. patent application Ser. No. 16/833,036 filed Mar. 27, 2020, which claims priority benefit of Chinese patent application no. 201910285346.3 filed Apr. 10, 2019, all of which are incorporated in their entirety by reference herein.

TECHNICAL FIELD

The present invention relates to a bamboo strip shaping device and method, belonging to the technical field of phyllostachys pubescens processing.

BACKGROUND

China is a large country of bamboo planting and bamboo industry. Bamboo products are closely related to people's lives and permeate every aspect of people's daily life. However, the natural tubular structure of the bamboo has a small radian, which does not facilitate the processing and utilization of curved bamboo strips. At the same time, the difference between curvature radii of different phyllostachys pubescens also limits their application. It is necessary to solve the problem how the bamboo can be processed into a specific radian, namely the same curvature radius, so as to facilitate the processing and utilization of the bamboo.

SUMMARY

In view of the technical problem to be solved, the present invention provides a bamboo strip shaping device and method, which achieve crack-free same-radian shaping and drying shaping of curved bamboo strips by a method of steam softening and then shaping and drying shaping for many times, and can widen the processing and utilization range of bamboos.

In order to solve the foregoing technical problem, the technical solution adopted by the present invention is as follows:

a bamboo strip shaping device, including an upper fixing plate and a lower fixing plate, where the upper fixing plate is connected to the lower fixing plate through supporting frames, an upper surface of the lower fixing plate is provided with a lower shaping plate, the lower shaping plate is provided with a lower steam injection channel, an upper surface of the upper fixing plate is provided with a limiting plate, a pressure plate is disposed above the limiting plate, connecting rod channels each for sliding a connecting rod is disposed in the upper fixing plate, pressing rods are each connected to a lower surface of the pressure plate, the pressing rod is connected to the connecting rod after passing through the limiting plate, an upper shaping plate is connected to a lower portion of the connecting rod, the upper shaping plate is provided with an upper steam injection channel, the upper shaping plate and the lower shaping plate each have an arc-shaped structure, the pressing rod is sleeved with a tension spring, an upper end of the tension spring is connected to a lower surface of the limiting plate, and a lower end of the tension spring is connected to an upper surface of the connecting rod.

The number of the connecting rods and the number of the pressing rods are each N, where N is an integer greater than or equal to 3.

A bamboo strip shaping method includes the following steps:

S01: cutting a bamboo tube, and removing inner joints, outer joints and bamboo outer skin;

S02: trisecting or quartering the bamboo tube in a longitudinal direction to obtain curved bamboo strips;

S03: placing the curved bamboo strips in a bamboo strip shaping device for processing;

S04: subjecting the curved bamboo strips to steam treatment and heating softening treatment;

S05: pressing and shaping the curved bamboo strips to obtain flattened bamboo strips, and drying for the first time under a maintained pressure;

S06: wetting bamboo outer skin surfaces and bamboo inner skin surfaces of the flattened bamboo strips, and drying for the second time; and S07: wetting the bamboo outer skin surfaces and the bamboo inner skin surfaces of the flattened bamboo strips, and drying for the third time.

In S01, a cut length of the bamboo tube is within 600 mm, and the bamboo outer skin removal is performed by installing limiting teeth on a bamboo outer skin removing milling spindle and applying an air pressure of 0.3-0.7 MPa, with a bamboo outer skin removal thickness of 0.4-0.7 mm.

In S04, the steam treatment temperature is 150-180° C. and the time is 5-10 min; and the heating softening treatment temperature is 150° C.

In S05, drying is performed until the water content is not greater than 12%.

In S06, the wetting process includes spraying water for 1 min, stopping for 10 min, then spraying water for 1 min and stopping for 10 min; and drying is set at 90° C. and is performed until the water content is not greater than 12%.

In S07, the wetting process includes spraying water for 2 min; and drying is set at 80° C. and is performed until the water content is not greater than 12%.

The present invention has the beneficial effects that the present invention provides a bamboo strip shaping device and method; first through steam softening of the whole bamboo strips, the transverse mechanical property of phyllostachys pubescens is reduced, and crack-free nick-free flattening of the curved bamboo strips is achieved; under pressurization, the shaping of bamboo strips with a specific radian is achieved by using a method of drying for many times, and the flattened bamboo strips do not recover and have good flatness; and the steam softening of the bamboo has lower energy consumption and higher efficiency.

BRIEF DESCRIPTION OF THE DRAWINGS

FIG. 1 is a schematic structural diagram of a bamboo strip shaping device according to the present invention.

The reference numbers in the FIGURE are as follows: 1. upper fixing plate; 2. lower fixing plate; 3. supporting frame; 4. lower shaping plate; 5. lower steam injection channel; 6. upper shaping plate; 7. upper steam injection channel; 8. curved bamboo strip; 9. limiting plate; 10. pressure plate; 11. connecting rod channel; 12. connecting rod; 13. pressing rod; 14. tension spring.

DESCRIPTION OF THE EMBODIMENTS

The present invention is further described below with reference to embodiments. The following embodiments are only used to explain the technical solutions of the present invention more clearly and cannot be used to limit the protection scope of the present invention.

Embodiment 1

As shown in FIG. 1, a bamboo strip shaping device includes an upper fixing plate 1 and a lower fixing plate 2, where the upper fixing plate 1 is connected to the lower fixing plate 2 through supporting frames 3. The supporting frames 3 are located on two sides. An upper surface of the lower fixing plate 2 is provided with a lower shaping plate 4, the lower shaping plate 4 is provided with a lower steam injection channel 5, an upper surface of the upper fixing plate 1 is provided with a limiting plate 9, a pressure plate 10 is disposed above the limiting plate 9, connecting rod channels 11 each for sliding a connecting rod 12 is disposed in the upper fixing plate 1, pressing rods 13 are each connected to a lower surface of the pressure plate 10, the pressing rod 13 is connected to the connecting rod 12 after passing through the limiting plate 9, and the limiting plate 9 is used to limit the up-and-down movement of the pressing rod 13. An upper shaping plate 6 is connected to a lower portion of the connecting rod 12, the upper shaping plate 6 is provided with an upper steam injection channel 7, the upper shaping plate 6 and the lower shaping plate 4 each have an arc-shaped structure, and curved bamboo strips 8 are placed between the upper shaping plate 6 and the lower shaping plate 4. The pressing rod 13 is sleeved with a tension spring 14, an upper end of the tension spring 14 is connected to a lower surface of the limiting plate 9, and a lower end of the tension spring 14 is connected to an upper surface of the connecting rod 12. Under normal circumstances, the tension spring 14 is in an elongated state and exerts an upward acting force on the connecting rod 12 to pull the upper shaping plate 6. After the curved bamboo strips 8 are placed on the lower shaping plate 4, the pressure plate 10 is pressed downward, and the upper shaping plate 6 moves downward to pressurize the curved bamboo strips 8. At this time, the length of the tension spring 14 increases. After the pressurization is completed, the upper shaping plate 6 is separated from the curved bamboo strips 8 under the restoring force of the tension spring 14. The number of the connecting rods 12 and the number of the pressing rods 13 are each N, where N is an integer which is greater than or equal to 3, preferably 7.

In the present invention, the bamboo wall thickness is 5-7 mm: when the bamboo outer radius is 60-80 mm, the radius of the lower shaping plate 4 is greater than 160 mm; when the bamboo outer radius is 80-100 mm, the inner arc radius of the lower shaping plate 4 is greater than 200 mm; and when the bamboo outer radius is 100-120 mm, the inner arc radius of the lower shaping plate 4 is greater than 230 mm. The bamboo wall thickness is 7-9 mm: when the bamboo outer radius is 80-100 mm, the inner arc radius of the lower shaping plate 4 is greater than 210 mm; and when the bamboo outer radius is 100-120 mm, the radius of the lower shaping plate 4 is greater than 250 mm. The bamboo wall thickness is 9-11 mm: when the bamboo outer radius is 80-100 mm, the radius of the lower shaping plate 4 is greater than 230 mm; and when the bamboo outer radius is 100-120 mm, the radius of the lower shaping plate 4 is greater than 270 mm.

The present invention further includes a bamboo strip shaping method, including the following steps.

Step 1: Select a bamboo tube with a wall thickness of 10 mm and an outer diameter of 102 mm, cut the bamboo tube into 500 mm first, and then remove inner joints, outer joints and bamboo outer skin, where bamboo outer skin removal is performed by installing limiting teeth on a bamboo outer skin removing milling spindle and applying an air pressure of 0.3-0.7 MPa, preferably 0.3 MPa, with a bamboo outer skin removal thickness of 0.4-0.7 mm, preferably 0.4 mm.

Step 2: Trisect or quarter the bamboo tube in a longitudinal direction through a round bamboo splitter to obtain curved bamboo strips 8.

Step 3: Place the curved bamboo strips 8 in a bamboo strip shaping device shown in FIG. 1 for processing, where the curved bamboo strips 8 are placed between an upper shaping plate 6 and a lower shaping plate 4, and the radius of the upper shaping plate 6 and the radius of the lower shaping plate 4 are 280 mm. Downward squeezing is performed.

Step 4: Perform steam treatment on the curved bamboo strips 8 through an upper steam injection channel 7 on the upper shaping plate 6 and a lower steam injection channel 5 on the lower shaping plate 4, where the steam treatment temperature is 150-180° C., preferably 150° C., and the time is 5-10 min, preferably 5 min; and the heating softening treatment temperature is performed through the upper shaping plate 6 and the lower shaping plate 4 at 150° C.

Step 5: Press a pressure plate 10 downward to press and shape the curved bamboo strips 8 to obtain flattened bamboo strips, and dry for the first time under a maintained pressure until the water content is not greater than 12%.

Step 6: Wet bamboo outer skin surfaces and bamboo inner skin surfaces of the flattened bamboo strips simultaneously through the upper steam injection channel 7 on the upper shaping plate 6 and the lower steam injection channel 5 on the lower shaping plate 4, where the wetting process includes spraying water for 1 min, stopping for 10 min, then spraying water for 1 min and stopping for 10 min; and dry the flattened bamboo strips for the second time through the upper shaping plate 6 and the lower shaping plate 4, where the drying is set at 90° C. and is performed until the water content is not greater than 12%.

Step 7: Wet bamboo outer skin surfaces and bamboo inner skin surfaces of the flattened bamboo strips simultaneously through the upper steam injection channel 7 on the upper shaping plate 6 and the lower steam injection channel 5 on the lower shaping plate 4, where the wetting process includes spraying water for 2 min; and dry the flattened bamboo strips for the third time through the upper shaping plate 6 and the lower shaping plate 4, where the drying is set at 80° C. and is performed until the water content is not greater than 12%.

Embodiment 2

As shown in FIG. 1, a bamboo strip shaping device includes an upper fixing plate 1 and a lower fixing plate 2, where the upper fixing plate 1 is connected to the lower fixing plate 2 through supporting frames 3. The supporting frames 3 are located on two sides. An upper surface of the lower fixing plate 2 is provided with a lower shaping plate 4, the lower shaping plate 4 is provided with a lower steam injection channel 5, an upper surface of the upper fixing plate 1 is provided with a limiting plate 9, a pressure plate 10 is disposed above the limiting plate 9, connecting rod channels 11 each for sliding a connecting rod 12 is disposed in the upper fixing plate 1, pressing rods 13 are each connected to a lower surface of the pressure plate 10, the pressing rod 13 is connected to the connecting rod 12 after passing through the limiting plate 9, and the limiting plate 9 is used to limit the up-and-down movement of the pressing rod 13. An upper shaping plate 6 is connected to a lower portion of the connecting rod 12, the upper shaping plate 6 is provided with an upper steam injection channel 7, the upper shaping plate 6 and the lower shaping plate 4 each have an arc-shaped structure, and curved bamboo strips 8 are placed between the upper shaping plate 6 and the lower shaping plate 4. The pressing rod 13 is sleeved with a tension spring 14, an upper end of the tension spring 14 is connected to a lower surface of the limiting plate 9, and a lower end of the tension spring 14 is connected to an upper surface of the connecting rod 12. Under normal circumstances, the tension spring 14 is in an elongated state and exerts an upward acting force on the connecting rod 12 to pull the upper shaping plate 6. After the curved bamboo strips 8 are placed on the lower shaping plate 4, the pressure plate 10 is pressed downward, and the upper shaping plate 6 moves downward to pressurize the curved bamboo strips 8. At this time, the length of the tension spring 14 increases. After the pressurization is completed, the upper shaping plate 6 is separated from the curved bamboo strips 8 under the restoring force of the tension spring 14. The number of the connecting rods 12 and the number of the pressing rods 13 are each N, where N is an integer which is greater than or equal to 3, preferably 7.

In the present invention, the bamboo wall thickness is 5-7 mm: when the bamboo outer radius is 60-80 mm, the radius of the lower shaping plate 4 is greater than 160 mm; when the bamboo outer radius is 80-100 mm, the inner arc radius of the lower shaping plate 4 is greater than 200 mm; and when the bamboo outer radius is 100-120 mm, the inner arc radius of the lower shaping plate 4 is greater than 230 mm. The bamboo wall thickness is 7-9 mm: when the bamboo outer radius is 80-100 mm, the inner arc radius of the lower shaping plate 4 is greater than 210 mm; and when the bamboo outer radius is 100-120 mm, the radius of the lower shaping plate 4 is greater than 250 mm. The bamboo wall thickness is 9-11 mm: when the bamboo outer radius is 80-100 mm, the radius of the lower shaping plate 4 is greater than 230 mm; and when the bamboo outer radius is 100-120 mm, the radius of the lower shaping plate 4 is greater than 270 mm.

The present invention further includes a bamboo strip shaping method, including the following steps.

Step 1: Select a bamboo tube with a wall thickness of 7 mm and an outer diameter of 79 mm, cut the bamboo tube into 500 mm first, and then remove inner joints, outer joints and bamboo outer skin, where bamboo outer skin removal is performed by installing limiting teeth on a bamboo outer skin removing milling spindle and applying an air pressure of 0.3-0.7 MPa, preferably 0.5 MPa, with a bamboo outer skin removal thickness of 0.4-0.7 mm, preferably 0.5 mm.

Step 2: Trisect or quarter the bamboo tube in a longitudinal direction through a round bamboo splitter to obtain curved bamboo strips 8.

Step 3: Place the curved bamboo strips 8 in a bamboo strip shaping device shown in FIG. 1 for processing, where the curved bamboo strips 8 are placed between an upper shaping plate 6 and a lower shaping plate 4, and the radius of the upper shaping plate 6 and the radius of the lower shaping plate 4 are 180 mm. Downward squeezing is performed.

Step 4: Perform steam treatment on the curved bamboo strips 8 through an upper steam injection channel 7 on the upper shaping plate 6 and a lower steam injection channel 5 on the lower shaping plate 4, where the steam treatment temperature is 150-180° C., preferably 150° C., and the time is 5-10 min, preferably 5 min; and the heating softening treatment temperature is performed through the upper shaping plate 6 and the lower shaping plate 4 at 150° C.

Step 5: Press a pressure plate 10 downward to press and shape the curved bamboo strips 8 to obtain flattened bamboo strips, and dry for the first time under a maintained pressure until the water content is not greater than 12%.

Step 6: Wet bamboo outer skin surfaces and bamboo inner skin surfaces of the flattened bamboo strips simultaneously through the upper steam injection channel 7 on the upper shaping plate 6 and the lower steam injection channel 5 on the lower shaping plate 4, where the wetting process includes spraying water for 1 min, stopping for 10 min, then spraying water for 1 min and stopping for 10 min; and dry the flattened bamboo strips for the second time through the upper shaping plate 6 and the lower shaping plate 4, where the drying is set at 90° C. and is performed until the water content is not greater than 12%.

Step 7: Wet bamboo outer skin surfaces and bamboo inner skin surfaces of the flattened bamboo strips simultaneously through the upper steam injection channel 7 on the upper shaping plate 6 and the lower steam injection channel 5 on the lower shaping plate 4, where the wetting process includes spraying water for 2 min; and dry the flattened bamboo strips for the third time through the upper shaping plate 6 and the lower shaping plate 4, where the drying is set at 80° C. and is performed until the water content is not greater than 12%.

Embodiment 3

As shown in FIG. 1, a bamboo strip shaping device includes an upper fixing plate 1 and a lower fixing plate 2, where the upper fixing plate 1 is connected to the lower fixing plate 2 through supporting frames 3. The supporting frames 3 are located on two sides. An upper surface of the lower fixing plate 2 is provided with a lower shaping plate 4, the lower shaping plate 4 is provided with a lower steam injection channel 5, an upper surface of the upper fixing plate 1 is provided with a limiting plate 9, a pressure plate 10 is disposed above the limiting plate 9, connecting rod channels 11 each for sliding a connecting rod 12 is disposed in the upper fixing plate 1, pressing rods 13 are each connected to a lower surface of the pressure plate 10, the pressing rod 13 is connected to the connecting rod 12 after passing through the limiting plate 9, and the limiting plate 9 is used to limit the up-and-down movement of the pressing rod 13. An upper shaping plate 6 is connected to a lower portion of the connecting rod 12, the upper shaping plate 6 is provided with an upper steam injection channel 7, the upper shaping plate 6 and the lower shaping plate 4 each have an arc-shaped structure, and curved bamboo strips 8 are placed between the upper shaping plate 6 and the lower shaping plate 4. The pressing rod 13 is sleeved with a tension spring 14, an upper end of the tension spring 14 is connected to a lower surface of the limiting plate 9, and a lower end of the tension spring 14 is connected to an upper surface of the connecting rod 12. Under normal circumstances, the tension spring 14 is in an elongated state and exerts an upward acting force on the connecting rod 12 to pull the upper shaping plate 6. After the curved bamboo strips 8 are placed on the lower shaping plate 4, the pressure plate 10 is pressed downward, and the upper shaping plate 6 moves downward to pressurize the curved bamboo strips 8. At this time, the length of the tension spring 14 increases. After the pressurization is completed, the upper shaping plate 6 is separated from the curved bamboo strips 8 under the restoring force of the tension spring 14. The number of the connecting rods 12 and the number of the pressing rods 13 are each N, where N is an integer which is greater than or equal to 3, preferably 7.

In the present invention, the bamboo wall thickness is 5-7 mm: when the bamboo outer radius is 60-80 mm, the radius of the lower shaping plate 4 is greater than 160 mm; when the bamboo outer radius is 80-100 mm, the inner arc radius of the lower shaping plate 4 is greater than 200 mm; and when the bamboo outer radius is 100-120 mm, the inner arc radius of the lower shaping plate 4 is greater than 230 mm. The bamboo wall thickness is 7-9 mm: when the bamboo outer radius is 80-100 mm, the inner arc radius of the lower shaping plate 4 is greater than 210 mm; and when the bamboo outer radius is 100-120 mm, the radius of the lower shaping plate 4 is greater than 250 mm. The bamboo wall thickness is 9-11 mm: when the bamboo outer radius is 80-100 mm, the radius of the lower shaping plate 4 is greater than 230 mm; and when the bamboo outer radius is 100-120 mm, the radius of the lower shaping plate 4 is greater than 270 mm.

The present invention further includes a bamboo strip shaping method, including the following steps.

Step 1: Select a bamboo tube with a wall thickness of 8 mm and an outer diameter of 90 mm, cut the bamboo tube into 500 mm first, and then remove inner joints, outer joints and bamboo outer skin, where bamboo outer skin removal is performed by installing limiting teeth on a bamboo outer skin removing milling spindle and applying an air pressure of 0.3-0.7 MPa, preferably 0.7 MPa, with a bamboo outer skin removal thickness of 0.4-0.7 mm, preferably 0.7 mm.

Step 2: Trisect or quarter the bamboo tube in a longitudinal direction through a round bamboo splitter to obtain curved bamboo strips 8.

Step 3: Place the curved bamboo strips 8 in a bamboo strip shaping device shown in FIG. 1 for processing, where the curved bamboo strips 8 are placed between an upper shaping plate 6 and a lower shaping plate 4, and the radius of the upper shaping plate 6 and the radius of the lower shaping plate 4 are 220 mm. Downward squeezing is performed.

Step 4: Perform steam treatment on the curved bamboo strips 8 through an upper steam injection channel 7 on the upper shaping plate 6 and a lower steam injection channel 5 on the lower shaping plate 4, where the steam treatment temperature is 150-180° C., preferably 150° C., and the time is 5-10 min, preferably 5 min; and the heating softening treatment temperature is performed through the upper shaping plate 6 and the lower shaping plate 4 at 150° C.

Step 5: Press a pressure plate 10 downward to press and shape the curved bamboo strips 8 to obtain flattened bamboo strips, and dry for the first time under a maintained pressure until the water content is not greater than 12%.

Step 6: Wet bamboo outer skin surfaces and bamboo inner skin surfaces of the flattened bamboo strips simultaneously through the upper steam injection channel 7 on the upper shaping plate 6 and the lower steam injection channel 5 on the lower shaping plate 4, where the wetting process includes spraying water for 1 min, stopping for 10 min, then spraying water for 1 min and stopping for 10 min; and dry the flattened bamboo strips for the second time through the upper shaping plate 6 and the lower shaping plate 4, where the drying is set at 90° C. and is performed until the water content is not greater than 12%.

Step 7: Wet bamboo outer skin surfaces and bamboo inner skin surfaces of the flattened bamboo strips simultaneously through the upper steam injection channel 7 on the upper shaping plate 6 and the lower steam injection channel 5 on the lower shaping plate 4, where the wetting process includes spraying water for 2 min; and dry the flattened bamboo strips for the third time through the upper shaping plate 6 and the lower shaping plate 4, where the drying is set at 80° C. and is performed until the water content is not greater than 12%.

The foregoing descriptions are only preferred implementations of the present invention. It should be noted that for a person of ordinary skill in the art, several improvements and modifications may further be made without departing from the principle of the present invention. These improvements and modifications should also be deemed as falling within the protection scope of the present invention.

What is claimed is:

1. A bamboo strip shaping device, comprising an upper fixing plate and a lower fixing plate, wherein the upper fixing plate is connected to the lower fixing plate through supporting frames, an upper surface of the lower fixing plate is provided with a lower shaping plate, the lower shaping plate is provided with a lower steam injection channel, an upper surface of the upper fixing plate is provided with a limiting plate, a pressure plate is disposed above the limiting plate, connecting rod channels each for sliding a connecting rod is disposed in the upper fixing plate, pressing rods are each connected to a lower surface of the pressure plate, the pressing rod is connected to the connecting rod after passing through the limiting plate, an upper shaping plate is connected to a lower portion of the connecting rod, the upper shaping plate is provided with an upper steam injection channel, the upper shaping plate and the lower shaping plate each have an arc-shaped structure, the pressing rod is sleeved with a tension spring, an upper end of the tension spring is connected to a lower surface of the limiting plate, and a lower end of the tension spring is connected to an upper surface of the connecting rod.

2. The bamboo strip shaping device according to claim 1, wherein the number of the connecting rods and the number of the pressing rods are each N, wherein N is an integer greater than or equal to 3.

* * * * *